US010229624B2

(12) United States Patent
Tanaka

(10) Patent No.: US 10,229,624 B2
(45) Date of Patent: Mar. 12, 2019

(54) METHOD OF ADJUSTING WHITE BALANCE, WHITE BALANCE ADJUSTMENT APPARATUS, AND DISPLAY DEVICE

(71) Applicant: Mitsubishi Electric Corporation, Tokyo (JP)

(72) Inventor: Shogo Tanaka, Tokyo (JP)

(73) Assignee: Mistubishi Electric Corporation, Tokyo (JP)

( * ) Notice: Subject to any disclaimer, the term of this patent is extended or adjusted under 35 U.S.C. 154(b) by 0 days.

(21) Appl. No.: 15/888,108

(22) Filed: Feb. 5, 2018

(65) Prior Publication Data

US 2018/0240388 A1 Aug. 23, 2018

(30) Foreign Application Priority Data

Feb. 22, 2017 (JP) ..... 2017-031274

(51) Int. Cl.
*G09G 3/20* (2006.01)
*G09G 3/36* (2006.01)

(52) U.S. Cl.
CPC ..... *G09G 3/2003* (2013.01); *G09G 3/3677* (2013.01); *G09G 3/3688* (2013.01); *G09G 2310/08* (2013.01); *G09G 2320/0242* (2013.01); *G09G 2320/0276* (2013.01)

(58) Field of Classification Search
None
See application file for complete search history.

(56) References Cited

U.S. PATENT DOCUMENTS 6,755,555 B2 6/2004 Bloom et al.
2017/0249888 A1 8/2017 Tanaka et al.

FOREIGN PATENT DOCUMENTS

JP 2003-244483 A 8/2003
JP 2005-328386 A 11/2005
JP 2008-145608 A 6/2008
JP 2008-530952 A 8/2008
JP 2009-225440 A 10/2009
JP 2015-133606 A 7/2015
WO 2006/088683 A1 8/2006

*Primary Examiner* — Michelle Chin
(74) *Attorney, Agent, or Firm* — Studebaker &Brackett PC

(57) ABSTRACT

A shift amount between a measurement value of a color value of white color and a calculation value of the color value of white color is calculated. Generated is a math formula in which the shift amount is reflected. Calculated is gradation values after the WB adjustment which the gradation values after the correction take in a case where the calculation value of the color value of the displayed color is a target color value of white color in the math formula. Contents of the WB correction are adjusted so that the gradation values after the correction is adjusted to be the gradation values after the WB adjustment in the case where the gradation values before the correction are specific gradation values.

6 Claims, 9 Drawing Sheets

METHOD OF ADJUSTING WHITE BALANCE, WHITE BALANCE ADJUSTMENT APPARATUS, AND DISPLAY DEVICE

BACKGROUND OF THE INVENTION

Field of the Invention

The present invention relates to a method of adjusting white balance, a white balance adjustment apparatus, and a display device.

Description of the Background Art

A liquid crystal display device emits light of red color (R), green color (G), and blue color (B), which are three primary colors of light, and combines the emitted light of R, G, and B, thereby generating light of colors to be displayed. The liquid crystal display device therefore generates the colors to be displayed by additive color mixture to combine R, G, and B. The colors to be displayed are adjusted by adjusting intensity of the emitted light of R, G, and B. Accordingly, in the liquid crystal display device, various colors are displayed by variously adjusting the intensity of the emitted light of R, G, and B.

When white color (W) is displayed in the liquid crystal display device, the intensity of the light of all colors of R, G, and B is basically maximized. However, there may be a case, depending on characteristics of the liquid crystal display device, where W having desired chromaticity is not displayed when the intensity of the light of all colors of R, G, and B is maximized. Thus, widely performed is a white balance (WB) correction in which the intensity of the light of the color selected from R, G, or B is set to be smaller than the maximum intensity to correct the chromaticity of W being displayed.

When the WB correction is performed, luminance of W being displayed decreases. Thus, in performing the WB correction, the intensity of the light of one or two colors selected from R, G, or B is set to maximum to suppress the reduction in the luminance of W being displayed, and the intensity of the light of the remaining color is determined so that W having the desired chromaticity is displayed.

For example, in a technique described in Japanese Patent Application Laid-Open No. 2015-133606, an intensity value selected from among intensity values $I_R$, $I_G$, and $I_B$ respectively corresponding to R, G, and B is reduced so that target white chromaticity of $x_w$ and $y_w$ can be acquired, and one of the intensity values $I_R$, $I_G$, and $I_B$ is maximized to reduce the amount of reduction in luminance (Paragraphs 0018 to 0029 in Japanese Patent Application Laid-Open No. 2015-133606).

In a conventional WB adjustment, a calculation for the WB adjustment is performed on an assumption that the additive color mixture is established. For example, in the technique described in Japanese Patent Application Laid-Open No. 2015-133606, the calculation for the WB adjustment is performed using Math (4) on the assumption that the additive color mixture is established (Paragraph 0027 in Japanese Patent Application Laid-Open No. 2015-133606).

However, there may be a case where the additive color mixture is not established depending on the characteristics of the liquid crystal display device. Thus, there may be a case where the chromaticity of W calculated from the intensity of the light of R, G, and B departs from the chromaticity of W which is actually displayed in the liquid crystal display device depending on the characteristics of the liquid crystal display device, so that W having the desired chromaticity is not displayed in spite of the WB adjustment. There are problems in the above case that a measurement of a color value needs to be repeated until W having the desired chromaticity is displayed, a calculation result does not converge and the WB adjustment cannot be therefore appropriately performed, a calculation error that the intensity of the light of one of R, G, and B is larger than the maximum intensity occurs, so that the WB adjustment cannot be appropriately performed. The above problems occur in a display device other than the liquid crystal display device, and also occur in a case where a primary color other than R, G, and B is adopted.

SUMMARY

It is an object of the present invention to reduce a repeat of a measurement of a color value and appropriately perform the WB adjustment even in a case where additive color mixture is not established.

The present invention is directed to a method of adjusting white balance (WB), a WB adjustment apparatus, and a display device.

Performed is a WB adjustment of a display device to perform a WB correction of correcting first to $n^{th}$ gradation values before a correction to be first to $n^{th}$ gradation values after the correction and display a displayed color in accordance the first to $n^{th}$ gradation values after the correction, n indicating an integral number of three or larger.

Acquired is a measurement value of a color value of white color in a case where the first to $n^{th}$ gradation values after the correction are first to $n^{th}$ specific gradation values for making the display device display white color, respectively, and the displayed color is white color.

A shift amount between a measurement value of a color value of white color and a calculation value of the color value of white color derived from the first to $n^{th}$ specific gradation values is calculated.

Generated is a math formula for deriving a calculation value of a color value of a displayed color from the first to $n^{th}$ gradation values after the correction, the shift amount being reflected in the math formula so that the calculation value of a color value of a displayed color is brought close to a measurement value of a color value of a displayed color.

Calculated are first to $n^{th}$ gradation values after a white balance adjustment which the first to $n^{th}$ gradation values after the correction take in the math formula, respectively, in a case where the calculation value of the color value of the displayed color is a target color value of white color.

Contents of the WB correction are adjusted so that the first to $n^{th}$ gradation values after the correction are respectively adjusted to be the first to $n^{th}$ gradation values after the WB adjustment in the case where the first to $n^{th}$ gradation values before the correction are first to $n^{th}$ specific gradation values respectively.

Since the math formula for appropriately deriving the color value of the color displayed by the display device from the first to $n^{th}$ gradation values after the correction can be acquired even in the case where the additive color mixture is not established, a repeat of a measurement of the color value is reduced, and the WB adjustment is appropriately performed.

These and other objects, features, aspects and advantages of the present invention will become more apparent from the following detailed description of the present invention when taken in conjunction with the accompanying drawings.

DESCRIPTION OF THE PREFERRED EMBODIMENTS

1 Embodiment 1

1.1 Introduction

The embodiment 1 relates to a liquid crystal display device.

1.2 Liquid Crystal Display Device

Figure 1:
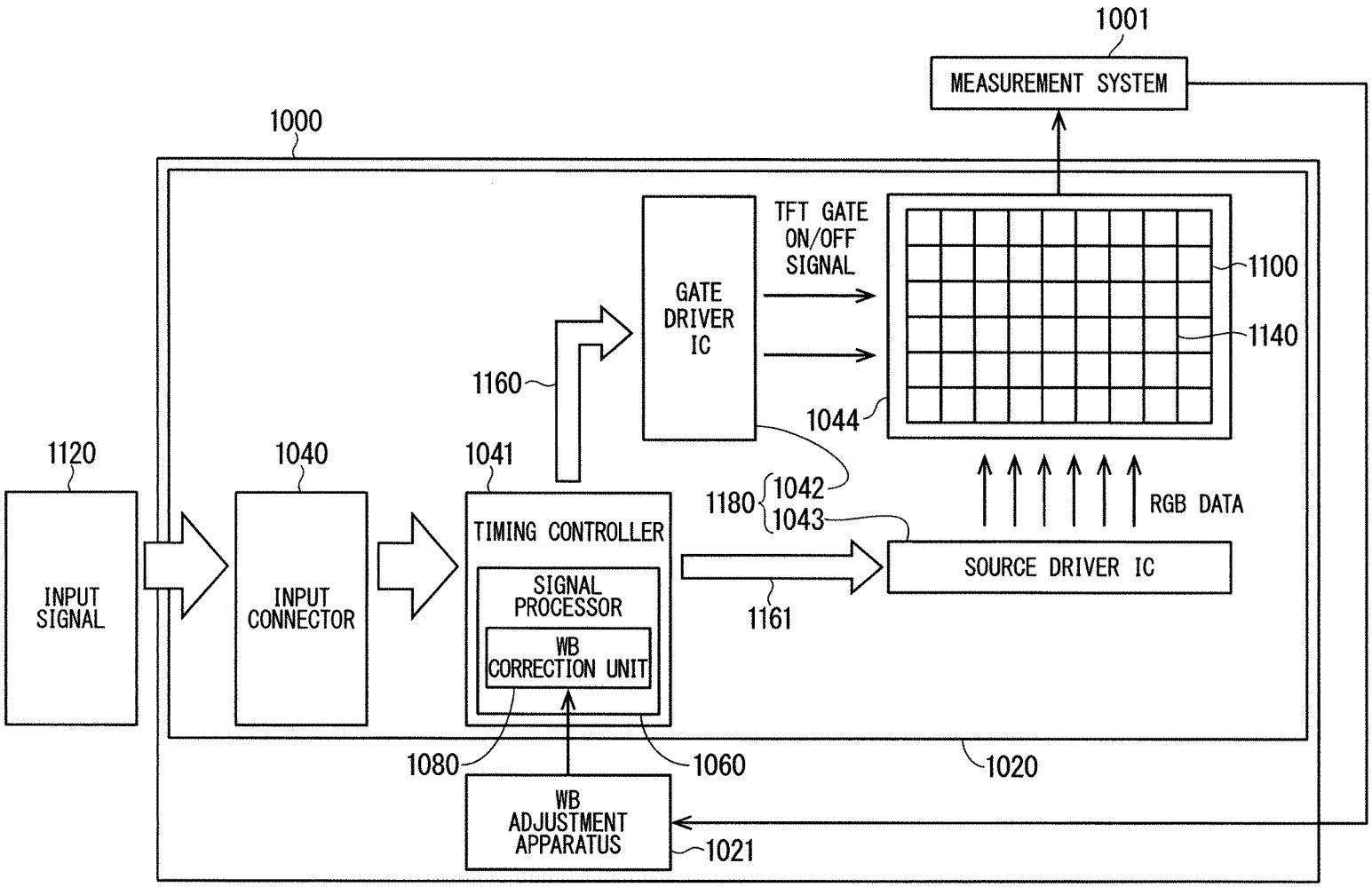
FIG. 1 is a block diagram illustrating a liquid crystal display device according to embodiments 1, 2, and 3 and a measurement system used for a white balance (WB) adjustment of the liquid crystal display device according to the embodiments 1, 2, and 3.

FIG. 1 is a block diagram illustrating a liquid crystal display device according to the embodiment 1 and a measurement system used for a white balance (WB) adjustment of the liquid crystal display device according to the embodiment 1.

A liquid crystal display device 1000 illustrated in FIG. 1 includes a display mechanism 1020 and a WB adjustment apparatus 1021.

In the embodiment 1, the liquid crystal display device 1000 on which the WB adjustment is not performed is prepared, and the WB adjustment of the prepared liquid crystal display device 1000 is performed. The liquid crystal display device 1000 on which the WB adjustment is performed is thereby manufactured. The WB adjustment of the liquid crystal display device 1000 is performed by the WB adjustment apparatus 1021 performing the WB adjustment of the display mechanism 1020.

The WB adjustment apparatus 1021 may be embedded in a display device other than the liquid crystal display device 1000. For example, the WB adjustment apparatus 1021 may be embedded in an organic electroluminescence (EL) display device or a micro electric mechanical system (MEMS).

1.3 Display Mechanism

The display mechanism 1020 includes, as illustrated in FIG. 1, an input connector 1040, a timing controller 1041, a gate driver integrated circuit (IC) 1042, a source driver IC 1043, and a liquid crystal panel 1044. The timing controller 1041 includes a signal processor 1060. The signal processor 1060 includes a WB correction unit 1080. The liquid crystal panel 1044 includes a plurality of pixels 1100. The display mechanism 1020 may include a constituent element other than the constituent element described above.

An input signal 1120 includes a signal containing image data. The image data includes gradation values (ri, gi, bi) for each pixel 1140 which is each pixel of the plurality of pixels 1100. The gradation values (ri, gi, bi) indicate color mixture amounts of red color (R), green color (G), and blue color (B) which are three primary colors, respectively. The gradation values (ri, gi, bi) may be replaced with three or more gradation values indicating color mixture amounts of three or more primary colors other than R, G, and B, respectively.

The input signal 1120, which is a digital electrical signal, is transmitted by wire, input to the input connector 1040, and input to the timing controller 1041 via the input connector 1040. The input signal 1120 may be replaced with an input signal which is wirelessly transmitted, and the input connector 1040 may be replaced with a receiver receiving the input signal which is wirelessly transmitted. The input signal 1120 may be replaced with an input signal which is an analog electrical signal, and the liquid crystal display device 1000 may include an A/D convertor which converts the input signal which is the analog electrical signal into the digital electrical signal, thereby acquiring the gradation values (ri, gi, bi).

The signal processor 1060 outputs a signal 1160 used to control a timing of driving each pixel 1140. The signal 1160 being output is input to the gate driver IC 1042. The signal processor 1060 processes the signal, being input, containing the image data, and outputs a signal 1161 used to control colors which are displayed by each pixel 1140. The signal 1161 being output is input to the source driver IC 1043.

The WB correction unit 1080 performs the WB correction of correcting the gradation values (ri, gi, bi) before the correction to be gradation values (r, g, b) after the correction during the generation of the signal 1161. The gradation values (r, g, b) after the correction indicate color mixture amounts of R, G, and B which are three primary colors, respectively. The gradation values (r, g, b) may be replaced with three of more gradation values indicating color mixture amounts of three or more primary colors other than R, G, and B, respectively.

The gate driver IC 1042 outputs an ON/OFF signal for controlling an ON/OFF of a thin film transistor (TFT) included in each pixel 1140 to a TFT gate based on the signal 1160.

The source driver IC 1043 outputs a color signal for controlling a color displayed by each pixel 1140 to a TFT source based on the signal 1161. The color signal reflects the gradation values (r, g, b).

The gate driver IC 1042 and the source driver IC 1043 constitute a drive circuit 1180 which makes each pixel 1140 display the color in accordance with the gradation values (r, g, b). The drive circuit 1180 may be replaced with a driver circuit having a configuration different from that of the drive circuit 1180.

The color in accordance with the gradation values (r, g, b) is displayed by each pixel 1140, thereby an image is displayed on the liquid crystal panel 1044.

1.4 Gradation Conversion

Figure 2:
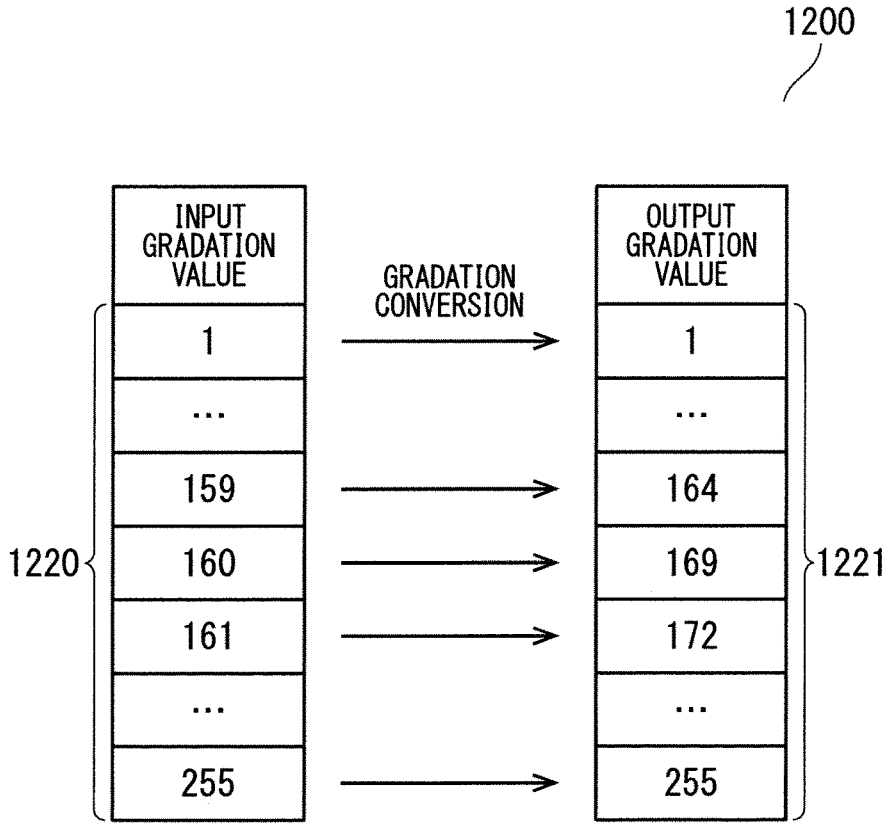
FIG. 2 is a drawing illustrating an example of a gradation conversion performed in a WB correction unit included in the liquid crystal display device according to the embodiments 1, 2, and 3.

FIG. 2 is a drawing illustrating an example of a gradation conversion performed in the WB correction unit included in the liquid crystal display device according to the embodiment 1.

A one-dimensional look-up table 1200 illustrated in FIG. 2 defines a gradation conversion characteristic when the gradation conversion of the gradation values before the gradation conversion into the gradation values after the gradation conversion is performed in performing the WB correction, includes 256 input gradation values 1220 of 1, . . . , 159, 160, 161, . . . , and 255, and includes 256 output gradation values 1221 of 1, . . . , 164, 169, 172, . . . , and 255 corresponding to the input gradation values 1220, respectively. Each of the 256 input gradation values 1220 is expressed by a bit string of 8 bits. Each of the 256 output gradation values 1221 is expressed by a bit string of 8 bits. The 256 input gradation values 1220 may be replaced with a plurality of input gradation values each expressed by a bit string of 7 bits or less or 9 bits or more. The 256 output gradation values 1221 may be replaced with a plurality of output gradation values each expressed by a bit string of 7 bits or less or 9 bits or more.

When the gradation conversion is performed in accordance with the one-dimensional look-up table 1200, the input gradation value which coincides with the gradation value before the gradation conversion is selected from among the 256 input gradation values 1220, and the output gradation value corresponding to the selected input gradation value is set to the gradation value after the gradation conversion. Accordingly, the gradation value before the gradation conversion is converted into the gradation value after the gradation conversion. For example, when the gradation value before the gradation conversion is 159, 160, or 161, the gradation value after the gradation conversion is set to 164, 169, or 172.

1.5 WB Adjustment Apparatus

Figure 3:
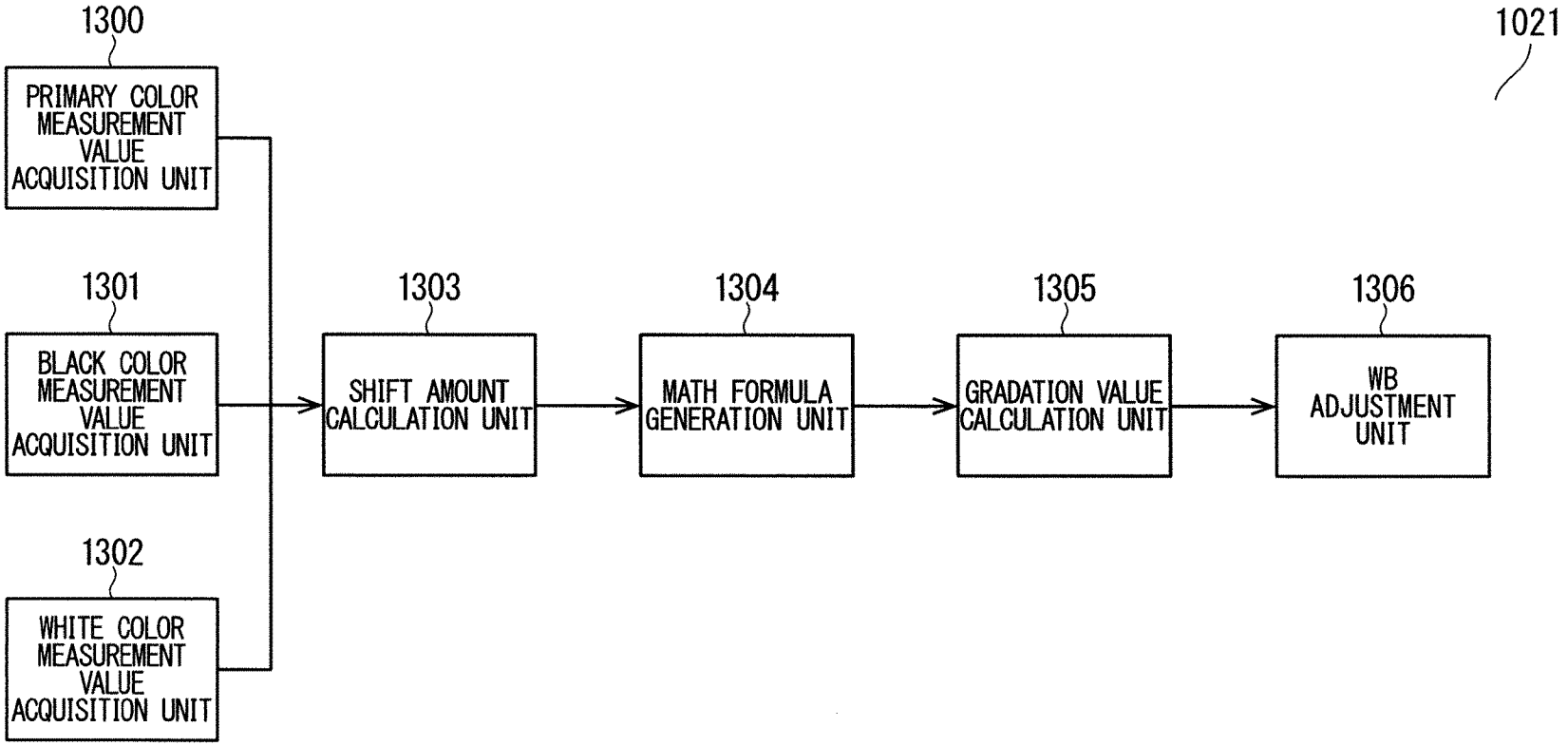
FIG. 3 is a block diagram illustrating a WB adjustment apparatus included in the liquid crystal display device according to the embodiments 1, 2, and 3.
Figure 4:
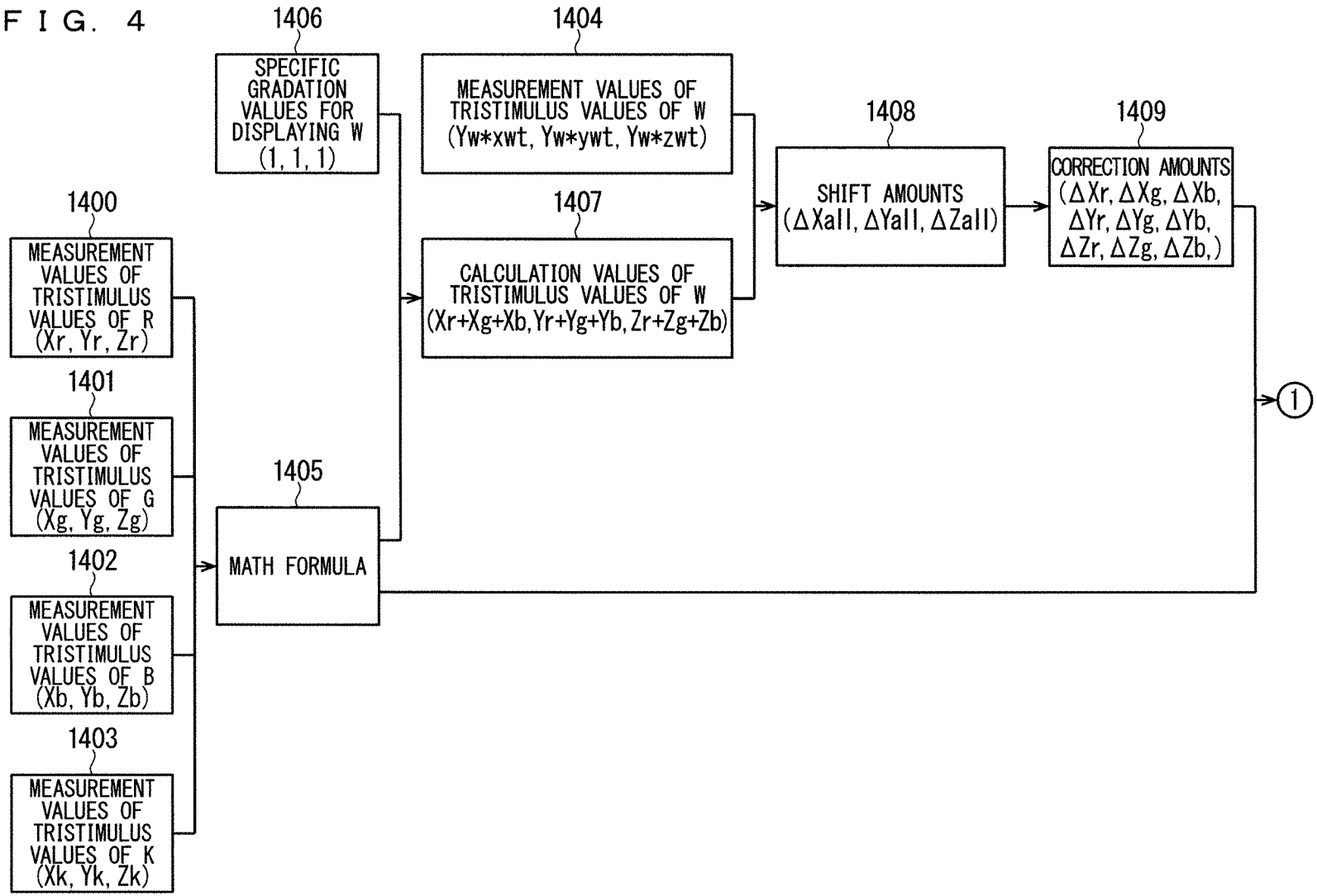
FIG. 4 is a drawing illustrating information used for the WB adjustment in the embodiments 1, 2, and 3.
Figure 5:
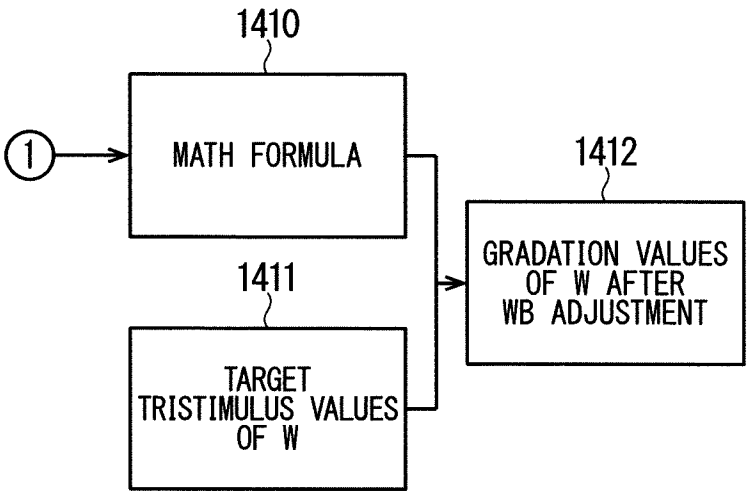
FIG. 5 is a drawing illustrating information used for the WB adjustment in the embodiments 1, 2, and 3.

FIG. 3 is a block diagram illustrating the WB adjustment apparatus included in the liquid crystal display device according to the embodiment 1. FIGS. 4 and 5 are drawings illustrating information used for the WB adjustment in the embodiment 1.

In the description hereinafter, each of the gradation values (r, g, b) is a relative value which is normalized to have a maximum gradation value of 1 and a minimum gradation value of 0.

The WB adjustment apparatus 1021 performs the WB adjustment for adjusting contents of the WB correction performed by the WB correction unit 1080 embedded in the liquid crystal display device 1000. As illustrated in FIG. 3, the WB adjustment apparatus 1021 includes a primary color measurement value acquisition unit 1300, a black color measurement value acquisition unit 1301, a white color measurement value acquisition unit 1302, a shift amount calculation unit 1303, a math formula generation unit 1304, a gradation value calculation unit 1305, and a WB adjustment unit 1306.

The primary color measurement value acquisition unit 1300, the black color measurement value acquisition unit 1301, the white color measurement value acquisition unit 1302, the shift amount calculation unit 1303, the math formula generation unit 1304, the gradation value calculation unit 1305, and the WB adjustment unit 1306 are achieved by making a computer execute a program. At least a part of the primary color measurement value acquisition unit 1300, the black color measurement value acquisition unit 1301, the white color measurement value acquisition unit 1302, the shift amount calculation unit 1303, the math formula generation unit 1304, the gradation value calculation unit 1305, and the WB adjustment unit 1306 may be achieved by hardware which does not execute a program.

The primary color measurement value acquisition unit 1300 acquires measurement values 1400 of tristimulus values of R which is singly displayed by the liquid crystal display device 1000, measurement values 1401 of tristimulus values of G which is singly displayed by the liquid crystal display device 1000, and measurement values 1402 of tristimulus values of B which is singly displayed by the liquid crystal display device 1000, illustrated in FIG. 4, from a measurement system 1001 illustrated in FIG. 1.

The black color measurement value acquisition unit 1301 acquires measurement values 1403 of tristimulus values of black (K) which is displayed by the liquid crystal display device 1000, illustrated in FIG. 4, from the measurement system 1001.

The white color measurement value acquisition unit 1302 acquires measurement values 1404 of tristimulus values of white (W) which is displayed by the liquid crystal display device 1000, illustrated in FIG. 4, from the measurement system 1001.

The shift amount calculation unit 1303 generates a math formula 1405 for deriving calculation values of the tristimulus values of the displayed color from the gradation values (r, g, b) illustrated in FIG. 4 from the acquired measurement values 1400 of the tristimulus values of R, the acquired measurement values 1401 of the tristimulus values of G, the acquired measurement values 1402 of the tristimulus values of B, and the acquired measurement values 1403 of the tristimulus values of K.

The shift amount calculation unit 1303 calculates calculation values 1407 of tristimulus values of W, illustrated in FIG. 4, from the generated math formula 1405 and specific gradation values 1406 for making the liquid crystal display device 1000 display W.

Furthermore, the shift amount calculation unit 1303 calculates shift amounts 1408 between measurement values 1404 of tristimulus values of W which have been acquired and the calculation values 1407 of the tristimulus values of W which have been calculated illustrated in FIG. 4.

The math formula generation unit 1304 calculates correction amounts 1409 illustrated in FIG. 4 from the calculated shift amounts 1408.

The math formula generation unit 1304 generates a math formula 1410 for deriving calculation values of the tristimulus values of the displayed color from the gradation values (r, g, b) illustrated in FIG. 5 from the calculated correction amounts 1409. The math formula 1410 is generated by correcting the generated math formula 1405 by the calculated correction amounts 1409. The correction amounts 1409 are calculated so that the calculation values of the tristimulus values of the displayed color gets close to the measurement values of the tristimulus values of the displayed color. The correction is performed so that the shift amounts are reflected in the math formula 1410.

The gradation value calculation unit 1305 calculates gradation values 1412 of W after the WB adjustment which the gradation values (r, g, b) take in a case where the calculation values of the tristimulus values of the displayed color is the target tristimulus values of W in the generated math formula 1410.

The WB adjustment unit 1306 updates the one-dimensional look-up table 1200, for example, to adjust contents of the WB correction performed by the WB correction unit 1080 so that the gradation values (r, g, b) are adjusted to be the gradation values 1412 of W after the WB adjustment in a case where the gradation values (ri, gi, bi) before the correction are the specific gradation values 1406 for displaying W.

The tristimulus values which are color values in an XYZ color space may be replaced with color values in a color space other than the XYZ color space.

1.6 Acquisition of Measurement Values of Tristimulus Values

Figure 6:
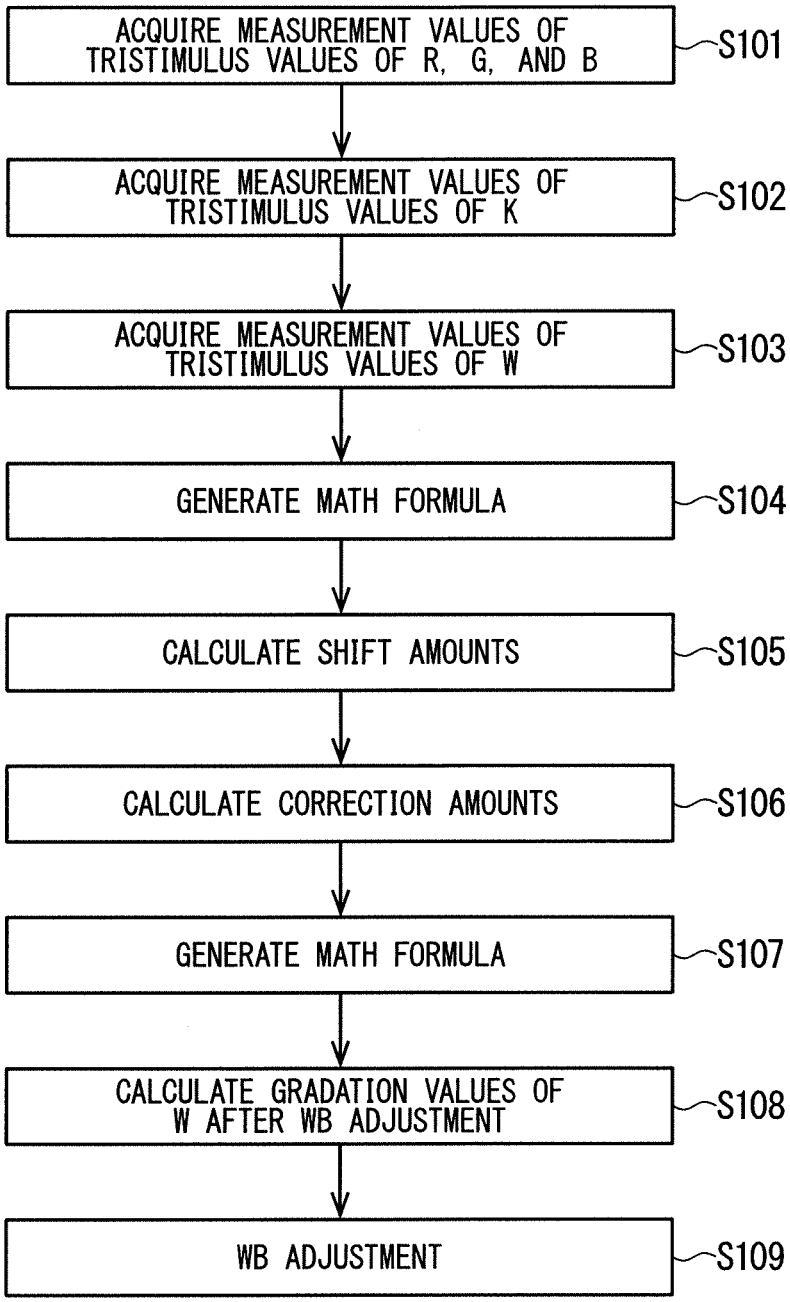
FIG. 6 is a flow chart illustrating a procedure of the WB adjustment in the embodiments 1, 2, and 3.

FIG. 6 is a flow chart illustrating a procedure of the WB adjustment in the embodiment 1.

In acquiring the measurement values (Xr, Yr, Zr) of the tristimulus values of R (the measurement values 1400 of the tristimulus values of R), the measurement values (Xg, Yg, Zg) of the tristimulus values of G (the measurement values 1401 of the tristimulus values of G), and the measurement values (Xb, Yb, Zb) of the tristimulus values of B (the measurement values 1402 of the tristimulus values of B), the measurement system 1001 measures the tristimulus values of each primary color of R, G, and B in a case where the gradation values of each primary color have the maximum gradation value of 1, the gradation values of a primary color other than each primary color have the minimum gradation value of 0, and the liquid crystal display device 1000 singly displays each primary color. The primary color measurement value acquisition unit 1300 acquires the measurement values of the tristimulus values of each primary color.

The primary color measurement value acquisition unit 1300 thereby acquires the measurement values (Xr, Yr, Zr) of the tristimulus values of R in the case where the gradation values (r, g, b) are (1, 0, 0) and the liquid crystal display device 1000 singly displays R. The primary color measurement value acquisition unit 1300 acquires the measurement values (Xg, Yg, Zg) of the tristimulus value of G in the case where the gradation values (r, g, b) are (0, 1, 0) and the liquid crystal display device 1000 singly displays G. The primary color measurement value acquisition unit 1300 acquires the measurement values (Xb, Yb, Zb) of the tristimulus values of B in the case where the gradation values (r, g, b) are (0, 0, 1) and the liquid crystal display device 1000 singly displays B (Step S101).

In acquiring the measurement values (Xk, Yk, Zk) of the tristimulus values of K (the measurement values 1403 of the tristimulus values of K), the measurement system 1001 measures the tristimulus value of K in the case where the gradation values (r, g, b) are (0, 0, 0) and the liquid crystal display device 1000 displays K. The black color measurement value acquisition unit 1301 acquires the measurement values (Xk, Yk, Zk) of the tristimulus values of K (Step S102). When the measurement values (Xk, Yk, Zk) of the tristimulus values of K is negligibly small, the execution of Step S102 is omitted, and the measurement values (Xk, Yk, Zk) of the tristimulus values of K is set to (0, 0, 0) in the subsequent processing.

In acquiring the measurement values (Yw*xwt, Yw*ywt, Yw*zwt) of the tristimulus values of W (the measurement values 1404 of the tristimulus values of W), the measurement system 1001 measures the tristimulus value of W in the case where the gradation values (r, g, b) are (1, 1, 1) and the liquid crystal display device 1000 displays W. The white color measurement value acquisition unit 1302 acquires the measurement values (Yw*xwt, Yw*ywt, Yw*zwt) of the tristimulus values of W (Step S103). A luminance value Yw is a luminance value of W in the case where the gradation values (r, g, b) are (1, 1, 1). The measurement values (xwt, ywt, zwt) of the tristimulus values of the normalized W are acquired by normalizing the measurement values of the tristimulus values of W by the luminance value Yw.

An order of execution of Steps S101, S102, and S103 may be changed.

1.7 Relational Expression in Case where Additive Color Mixture is Established

A relational expression of Math (1) indicates a relationship among the measurement values (Xr, Yr, Zr) of the tristimulus values of R, the measurement values (Xg, Yg, Zg) of the tristimulus values of G, the measurement values (Xb, Yb, Zb) of the tristimulus values of B, the measurement values (Xk, Yk, Zk) of the tristimulus values of K, the luminance value Yw, the normalized measurement values (xwt, ywt, zwt) of the tristimulus values of W, and the gradation values (r, g, b) in a case where the additive color mixture is established.

[Math 1]

$$\begin{bmatrix} Xr & Xg & Xb \\ Yr & Yg & Yb \\ Zr & Zg & Zb \end{bmatrix} \begin{bmatrix} r \\ g \\ b \end{bmatrix} + \begin{bmatrix} Xk \\ Yk \\ Zk \end{bmatrix} = Yw \begin{bmatrix} xwt \\ ywt \\ zwt \end{bmatrix} \tag{1}$$

The gradation values (r, g, b) are defined in a domain indicated by Math (2) and satisfies a maximum luminance condition indicated by Math (3) when the liquid crystal display device 1000 displays W.

[Math 2]

$$0 \le r \le 1, 0 \le g \le 1, 0 \le b \le 1 \tag{2}$$

[Math 3]

$$\max(r, g, b) = 1 \tag{3}$$

A left-hand side of Math (1) is a math formula (the math formula 1405) for deriving the calculation values (Xr*r+Xg*g+Xb*b+Xk, Yr*r+Yg*g+Yb*b+Yk, Zr*r+Zg*g+Zb*b+Zk) of the tristimulus values of the displayed color from the gradation values (r, g, b). A right-hand side of Math (1) indicates the measurement values (Yw*xwt, Yw*ywt, Yw*zwt) of the tristimulus values of W (the measurement values 1404 of the tristimulus values of W). Accordingly, the relational expression of Math (1) indicates that the calculation values of the tristimulus values of W derived from the gradation values (r, g, b) by the math formula of the left-hand side of Math (1) coincides with the measurement values of the tristimulus values of W in case where additive color mixture is established. However, there may be a case where Math (1) is not established in the liquid crystal display device 1000.

1.8 Generation of Math Formula and Calculation of Shift Amount

The shift amount calculation unit 1303 generates the math formula of the left-hand side of Math (1) from the measurement values (Xr, Yr, Zr) of the tristimulus values of R, the measurement values (Xg, Yg, Zg) of the tristimulus values of G, the measurement values (Xb, Yb, Zb) of the tristimulus values of B, and the measurement values (Xk, Yk, Zk) of the tristimulus values of K (Step S104).

The shift amount calculation unit 1303 calculates the calculation values (Xr+Xg+Xb, Yr+Yg+Yb, Zr+Zg+Zb) of the tristimulus values of W (the calculation values 1407 of the tristimulus values of W) which the calculation values (Xr*r+Xg*g+Xb*b+Xk, Yr*r+Yg*g+Yb*b+Yk, Zr*r+Zg*g+Zb*b+Zk) of the tristimulus values of the displayed color derived from the math formula of the left-hand side of Math (1) take in the case where the gradation values (r, g, b) are the specific gradation values (1, 1, 1) for displaying W (the specific gradation values 1406 for displaying W) in the math formula of the left-hand side of Math (1). Herein, the measurement values (Xk, Yk, Zk) of the tristimulus values of K are set to (0, 0, 0).

Furthermore, the shift amount calculation unit 1303 calculates an X component ΔXall of the shift amounts, which is a difference between the measurement value Yw*xwt of an X component of the tristimulus values of W and the calculation value Xr+Xg+Xb of an X component of the tristimulus values of W derived from the specific gradation values (1, 1, 1) by the math formula of the left-hand side of Math (1), indicated by Math (4). The shift amount calculation unit 1303 calculates a Y component ΔYall of the shift amounts, which is a difference between the measurement value Yw*ywt of a Y component of the tristimulus values of W and the calculation value Yr+Yg+Yb of a Y component of the tristimulus values of W derived from the specific gradation values (1, 1, 1) by the math formula of the left-hand side of Math (1), indicated by Math (5). The shift amount calculation unit 1303 calculates a Z component ΔZall of the shift amounts, which is a difference between the measurement value Yw*zwt of a Z component of the tristimulus values of W and the calculation value Zr+Zg+Zb of a Z component of the tristimulus values of W derived from the specific gradation values (1, 1, 1) by the math formula of the left-hand side of Math (1), indicated by Math (6) (Step S105).

[Math 4]

$$\Delta Xall = Yw*xwt-(Xr+Xg+Xb) \tag{4}$$

[Math 5]

$$\Delta Yall = Yw*ywt-(Yr+Yg+n) \tag{5}$$

[Math 6]

$$\Delta Zall = Yw*zwt-(Zr+Zg+Zb) \tag{6}$$

The shift amounts (ΔXall, ΔYall, ΔZall) (the shift amounts 1408) serves as a barometer indicating a degree of failure in the additive color mixture in accordance with characteristics of the liquid crystal display device 1000.

The shift amounts (ΔXall, ΔYall, ΔZall) is basically a barometer in a case where the gradation values (r, g, b) are (1, 1, 1). However, when a second WB adjustment is performed subsequent to a first WB adjustment, for example, the shift amounts (ΔXall, ΔYall, ΔZall) may be a barometer in a case where the gradation values (r, g, b) are specific gradation values other than (1, 1, 1).

1.9 Calculation of Correction Amount and Generation of Math Formula

The math formula generation unit 1304 proportionally divides the X component ΔXall of the shift amounts including contribution of all the gradation values (r, g, b)=(1, 1, 1) into the X component correction amounts (ΔXr, ΔXg, ΔXb) respectively corresponding to contribution rates of the gradation values (r, g, b)=(1, 1, 1) contributing to the X component ΔXall of the shift amounts. The X component correction amounts (ΔXr, ΔXg, ΔXb) are expressed by Math (7), Math (8), and Math (9), respectively.

[Math 7]

$$\Delta Xr = \Delta Xall * \frac{Xr}{Xr + Xg + Xb} \tag{7}$$

[Math 8]

$$\Delta Xg = \Delta Xall * \frac{Xg}{Xr + Xg + Xb} \tag{8}$$

[Math 9]

$$\Delta Xb = \Delta Xall * \frac{Xb}{Xr + Xg + Xb} \tag{9}$$

The math formula generation unit 1304 proportionally divides the Y component ΔYall of the shift amounts including contribution of all the gradation values (r, g, b)=(1, 1, 1) into the Y component correction amounts (ΔYr, ΔYg, ΔYb) respectively corresponding to contribution rates of the gradation values (r, g, b)=(1, 1, 1) contributing to the Y component ΔYall of the shift amounts. The Y component correction amounts (ΔYr, ΔYg, ΔYb) are expressed by Math (10), Math (11), and Math (12), respectively.

[Math 10]

$$\Delta Yr = \Delta Yall * \frac{Yr}{Yr + Yg + Yb} \tag{10}$$

[Math 11]

$$\Delta Yg = \Delta Yall * \frac{Yg}{Yr + Yg + Yb} \tag{11}$$

[Math 12]

$$\Delta Yb = \Delta Yall * \frac{Yb}{Yr + Yg + Yb} \tag{12}$$

The math formula generation unit 1304 proportionally divides the Z component ΔZall of the shift amounts including contribution of all the gradation values (r, g, b)=(1, 1, 1) into the Z component correction amounts (ΔZr, ΔZg, ΔZb) respectively corresponding to contribution rates of the gradation values (r, g, b)=(1, 1, 1) contributing to the Z component ΔZall of the shift amounts (Step S106). The Z component correction amounts (ΔZr, ΔZg, ΔZb) are expressed by Math (13), Math (14), and Math (15), respectively.

[Math 13]

$$\Delta Zr = \Delta Zall * \frac{Zr}{Zr + Zg + Zb} \tag{13}$$

[Math 14]

$$\Delta Zg = \Delta Zall * \frac{Zg}{Zr + Zg + Zb} \tag{14}$$

[Math 15]

$$\Delta Zb = \Delta Zall * \frac{Zb}{Zr + Zg + Zb} \tag{15}$$

Furthermore, the math formula generation unit 1304 corrects the math formula of the left-hand side of Math (1)

using the correction amounts (ΔXr, ΔXg, ΔXb, ΔYr, ΔYg, ΔYb, ΔZr, ΔZg, ΔZb) indicating an offset (the correction amounts 1409), thereby generating a math formula of the left-hand side of Math (16) (the math formula 1410) (Step S107).

[Math 16]

$$\begin{bmatrix} Xr+\Delta Xr & Xg+\Delta Xg & Xb+\Delta Xb \\ Yr+\Delta Yr & Yg+\Delta Yg & Yb+\Delta Yb \\ Zr+\Delta Zr & Zg+\Delta Zg & Zb+\Delta Zb \end{bmatrix} \begin{bmatrix} r \\ g \\ b \end{bmatrix} + \begin{bmatrix} Xk \\ Yk \\ Zk \end{bmatrix} = Yw \begin{bmatrix} xwt \\ ywt \\ zwt \end{bmatrix} \quad (16)$$

In the correction, the X component correction amounts (ΔXr, ΔXg, ΔXb) are respectively added to the X component coefficients (Xr, Xg, Xb) before the correction included in the math formula of the left-hand side of Math (1), thus the X component coefficients (Xr+ΔXr, Xg+ΔXg, Xb+ΔXb) after the correction included in the math formula of the left-hand side of Math (16) is acquired. The Y component correction amounts (ΔYr, ΔYg, ΔYb) are respectively added to the Y component coefficients (Yr, Yg, Yb) before the correction included in the math formula of the left-hand side of Math (1), thus the Y component coefficients (Yr+ΔYr, Yg+ΔYg, Yb+ΔYb) after the correction included in the math formula of the left-hand side of Math (16) is acquired. The Z component correction amounts (ΔZr, ΔZg, ΔZb) are respectively added to the Z component coefficients (Zr, Zg, Zb) before the correction included in the math formula of the left-hand side of Math (1), thus the Z component coefficients (Zr+ΔZr, Zg+ΔZg, Zb+ΔZb) included in the math formula of the left-hand side of Math (16) is acquired.

X component coefficients (Xr+ΔXr, Xg+ΔXg, Xb+ΔXb) after the correction respectively indicate degrees of contribution of the gradation values (r, g, b) to the calculation value of the X component of the tristimulus values of the displayed color. The X component correction amounts (ΔXr, ΔXg, ΔXb) are respectively included in the X component coefficients (Xr+ΔXr, Xg+ΔXg, Xb+ΔXb) after the correction, and serves as factors respectively added to the X component coefficients (Xr, Xg, Xb) before the correction. Y component coefficients (Yr+ΔYr, Yg+ΔYg, Yb+ΔYb) after the correction respectively indicate degrees of contribution of the gradation values (r, g, b) to the calculation value of the Y component of the tristimulus values of the displayed color. The Y component correction amounts (ΔYr, ΔYg, ΔYb) are respectively included in the Y component coefficients (Yr+ΔYr, Yg+ΔYg, Yb+ΔYb) after the correction, and serves as factors respectively added to the Y component coefficients (Yr, Yg, Yb) before the correction. Z component coefficients (Zr+ΔZr, Zg+ΔZg, Zb+ΔZb) respectively indicate degrees of contribution of the gradation values (r, g, b) to the calculation value of Z component of the tristimulus values of the displayed color. Z component correction amounts (ΔZr, ΔZg, ΔZb) are respectively included in the Z component coefficients (Zr+ΔZr, Zg+ΔZg, Zb+ΔZb) after the correction, and serves as factors respectively added to the Z component coefficients (Zr, Zg, Zb) before the correction.

Accordingly, the correction amounts (ΔXr, ΔXg, ΔXb, ΔYr, ΔYg, ΔYb, ΔZr, ΔZg, ΔZb) are reflected in the math formula of the left-hand side of Math (16) deriving the calculation values ((Xr+ΔXr)*r+(Xg+ΔXg)*g+(Xb+ΔXb)*b+Xk, (Yr+ΔYr)*r+(Yg+ΔYg)*g+(Yb+ΔYb)*b+Yk, (Zr+ΔZr)*r+(Zg+ΔZg)*g+(Zb+ΔZb)*b+Zk) of the tristimulus value of the displayed color from the gradation values (r, g, b), and the shift amounts (ΔXall, ΔYall, ΔZall) are reflected in the math formula of the left-hand side of Math (16), thus the calculation values of the tristimulus values of the displayed color derived by the math formula of the left-hand side of Math (16) is brought close to the measurement values of the tristimulus values of the displayed color.

1.10 Calculation of Gradation Values of W after WB Adjustment

The gradation value calculation unit 1305 calculates the gradation values of W after the WB adjustment (the gradation values 1412 of W after the WB adjustment) which the gradation values (r, g, b) take in the case where the calculation values of the tristimulus values of the displayed color are target tristimulus values of W (target tristimulus values 1411 of W) in the math formula of the left-hand side of Math (16), in other words, the gradation values of W after the WB adjustment which the gradation values (r, g, b) take in the case where xwt, ywt, and zwt on the right-hand side of Math (16) are replaced with the tristimulus values acquired by normalizing the target tristimulus values of W by the luminance value Yw (Step S108).

A calculation described below, for example, is performed in calculating the gradation values of W after the WB adjustment.

Firstly, the coefficients Xr+ΔXr, Xg+ΔXg, Xb+ΔXb, Yr+ΔYr, Yg+ΔYg, Yb+ΔYb, Zr+ΔZr, Zg+ΔZg and Zb+ΔZb are replaced with Xr', Xg', Xb', Yr', Yg', Yb', Zr', Zg' and Zb', respectively, as indicated by Math (17), and Math (16) is transformed into Math (18).

[Math 17]

$$\begin{bmatrix} Xr' & Xg' & Xb' \\ Yr' & Yg' & Yb' \\ Zr' & Zg' & Zb' \end{bmatrix} = \begin{bmatrix} Xr+\Delta Xr & Xg+\Delta Xg & Xb+\Delta Xb \\ Yr+\Delta Yr & Yg+\Delta Yg & Yb+\Delta Yb \\ Zr+\Delta Zr & Zg+\Delta Zg & Zb+\Delta Zb \end{bmatrix} \quad (17)$$

[Math 18]

$$\begin{bmatrix} -Xwt & Xr' & Xg' & Xb' \\ -Ywt & Yr' & Yg' & Yb' \\ -Zwt & Zr' & Zg' & Zb' \end{bmatrix} \begin{bmatrix} Yw \\ r \\ g \\ b \end{bmatrix} = \begin{bmatrix} -Xk \\ -Yk \\ -Zk \end{bmatrix} \quad (18)$$

Since at least one of the gradation values (r, g, b) needs to be "1", it is specified which of the gradation values (r, g, b) is "1".

Figure 7:
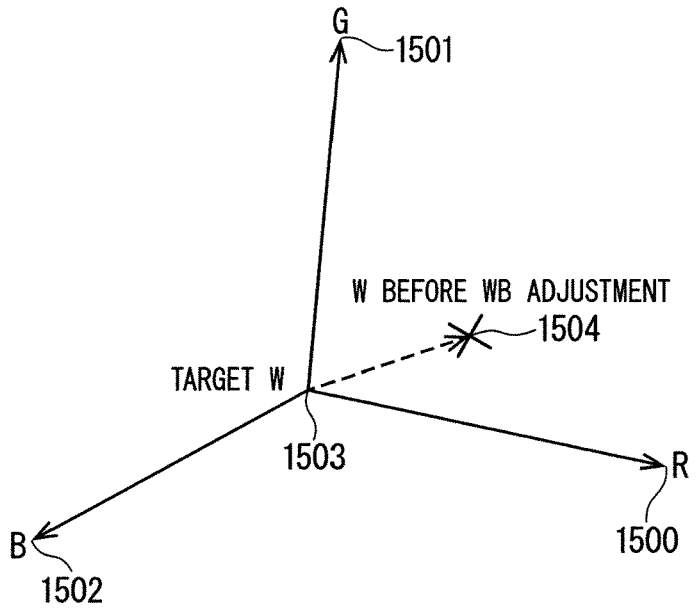
FIG. 7 is a drawing illustrating an RGB color space used for the WB adjustment in the embodiments 1, 2, and 3.

FIG. 7 is a drawing illustrating an RGB color space used for the WB adjustment in the embodiment 1.

In specifying which of the gradation values (r, g, b) is "1", a region including a W coordinate 1504 before the WB adjustment is determined from a standard R coordinate 1500, a standard G coordinate 1501, a standard B coordinate 1502, and a target W coordinate 1503 in the RGB color space illustrated in FIG. 7. In the RGB color space illustrated in FIG. 7, the target W coordinate 1503 is an origin.

The W coordinate 1504 before the WB adjustment is expressed by, as indicated by Math (19), Math (20), and Math (21), a linear combination of two vectors selected from a vector directed from the origin 1503 toward the standard R coordinate 1500, a vector directed from the origin 1503 toward the standard G coordinate 1501, and a vector directed from the origin 1503 toward the standard B coordinate 1502.

[Math 19]

$$\overrightarrow{W \text{ before adjustment}} = p \cdot \vec{R} + q \cdot \vec{G} \tag{19}$$

[Math 20]

$$\overrightarrow{W \text{ before adjustment}} = p \cdot \vec{G} + q \cdot \vec{B} \tag{20}$$

[Math 21]

$$\overrightarrow{W \text{ before adjustment}} = p \cdot \vec{B} + q \cdot \vec{R} \tag{21}$$

When p>0 and q>0 are satisfied in Math (19), a gradation value b is "1". When p>0 and q>0 are satisfied in Math (20), a gradation value r is "1". When p>0 and q>0 are satisfied in Math (21), a gradation value g is "1". Each of states where the gradation value r is "1", the gradation value g is "1", and the gradation value b is "1" is expressed by a matrix operation. For example, the state where the gradation value b is "1" is expressed by Math (22).

[Math 22]

$$\text{Example) } \begin{bmatrix} 0 & 0 & 1 \end{bmatrix} \begin{bmatrix} r \\ g \\ b \end{bmatrix} = 1 \tag{22}$$

Math (18) and Math (22) are combined to generate Math (23).

[Math 23]

$$\begin{bmatrix} -Xwt & Xr' & Xg' & Xb' \\ -Ywt & Yr' & Yg' & Yb' \\ -Zwt & Zr' & Zg' & Zb' \\ 0 & 0 & 0 & 1 \end{bmatrix} \begin{bmatrix} Yw \\ r \\ g \\ b \end{bmatrix} = \begin{bmatrix} -Xk \\ -Yk \\ -Zk \\ 1 \end{bmatrix} \tag{23}$$

Math (23) is transformed into Math (24). According to Math (24), not only the gradation values of W after the WB adjustment but also the luminance value Yw are calculated.

[Math 24]

$$\begin{bmatrix} Yw \\ r \\ g \\ b \end{bmatrix} = \begin{bmatrix} -Xwt & Xr' & Xg' & Xb' \\ -Ywt & Yr' & Yg' & Yb' \\ -Zwt & Zr' & Zg' & Zb' \\ 0 & 0 & 0 & 1 \end{bmatrix}^{-1} \begin{bmatrix} -Xk \\ -Yk \\ -Zk \\ 1 \end{bmatrix} \tag{24}$$

The luminance value Yw' of W after the WB adjustment and the normalized tristimulus values (Xwt', Ywt', Zwt') of the W after the WB adjustment are specified by Math (25).

[Math 25]

$$Yw' \begin{bmatrix} Xwt' \\ Ywt' \\ Zwt' \end{bmatrix} = r \begin{bmatrix} Xr \\ Yr \\ Zr \end{bmatrix} + g \begin{bmatrix} Xg \\ Yg \\ Zg \end{bmatrix} + b \begin{bmatrix} Xz \\ Yz \\ Zz \end{bmatrix} \tag{25}$$

1.11 WB Adjustment

The WB adjustment unit 1306 adjusts the contents of the WB correction performed by the WB correction unit 1080 so that the gradation values (r, g, b) are adjusted to be the above mentioned gradation values of W after the WB adjustment in a case where the gradation values (ri, gi, bi) before the correction are the specific gradation values (r, g, b)=(1, 1, 1) for displaying W (Step S109).

1.12 Comparison Between Conventional WB Adjustment and WB Adjustment According to Embodiment 1

Figure 8:
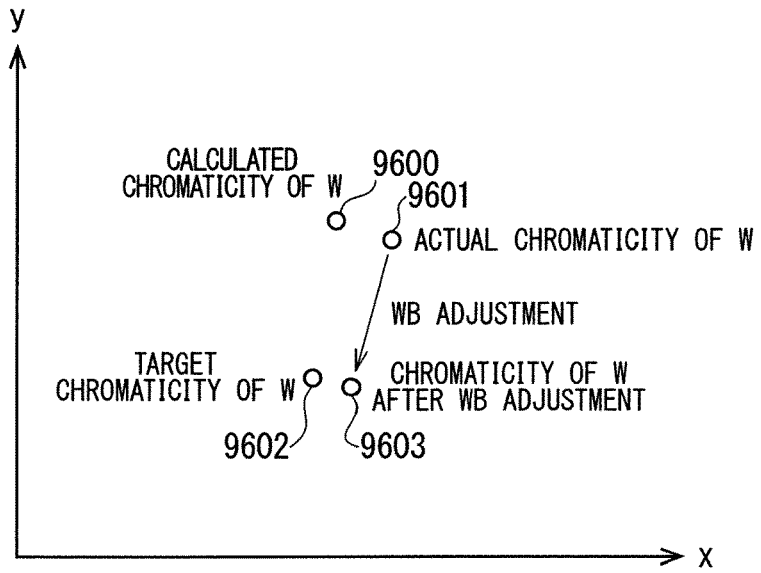
FIG. 8 is a drawing illustrating a relationship of chromaticity in a conventional WB adjustment.
Figure 9:
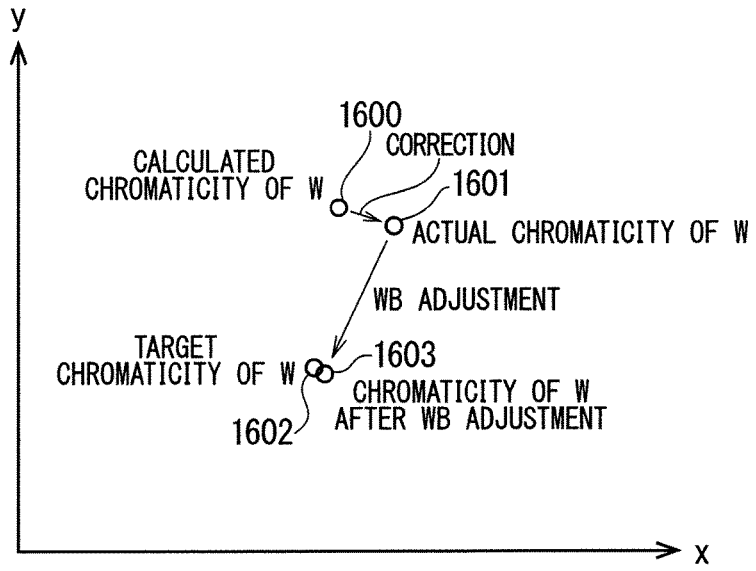
FIG. 9 is a drawing illustrating a relationship of chromaticity in the WB adjustment in the embodiments 1 and 2.

FIG. 8 is a drawing illustrating a relationship of chromaticity in the conventional WB adjustment. FIG. 9 is a drawing illustrating a relationship of chromaticity in the WB adjustment according to the embodiment 1.

In the conventional WB adjustment, as illustrated in FIG. 8, a calculated chromaticity 9600 of W departs from an actual chromaticity 9601 of W. Accordingly, even after the WB adjustment for adjusting the calculated chromaticity 9600 of W to a target chromaticity 9602 of W is performed, a chromaticity 9603 of W after the WB adjustment still departs from the target chromaticity 9602 of W.

In contrast, in the WB adjustment according to the embodiment 1, as illustrated in FIG. 9, a correction of bringing a calculated chromaticity 1600 of W close to an actual chromaticity 1601 of W is performed. Accordingly, after the WB adjustment for adjusting the calculated chromaticity 1600 of W to a target chromaticity 1602 of W is performed, a chromaticity 1603 of W after the WB adjustment gets close to the target chromaticity 1602 of W.

Such a difference occurs because in the WB adjustment according to the embodiment 1, the math formula for appropriately deriving the tristimulus values of the color displayed by the liquid crystal display device 1000 from the gradation values (r, g, b) is acquired even in the case where the additive color mixture is not established. According to the WB adjustment according to the embodiment 1, the repetitive measurement of the tristimulus values is reduced, and the WB adjustment is appropriately performed.

2 Embodiment 2

The embodiment 2 relates to a liquid crystal display device being substitute for the liquid crystal display device according to the embodiment 1.

FIG. 1 to FIG. 7 and FIG. 9 also describe the liquid crystal display device according to the embodiment 2.

Described mainly hereinafter is a difference between the liquid crystal display device according to the embodiment 1 and the liquid crystal display device according to the embodiment 2.

In the embodiment 1, the shift amounts (ΔXall, ΔYall, ΔZall) are basically the barometer in the case where the gradation values (r, g, b) are (1, 1, 1), however, the shift amounts (ΔXall, ΔYall, ΔZall) may be the barometer in the case where the gradation values (r, g, b) are specific gradation values other than (1, 1, 1). The above is premised on a state where a relationship between the shift amounts (ΔXall, ΔYall, ΔZall) and the gradation values (r, g, b) has a linear shape. That is to say, the above is premised on a state where the shift amounts (ΔXall, ΔYall, ΔZall) are accurately calculated in the case where the gradation values (r, g, b) are the specific gradation values even when the values (Xr, Yr, Zr, Xg, Yg, Zg, Xb, Yb, Zb, Yw, xwt, ywt, zwt) which are the base of the calculation of the shift amounts (ΔXall, ΔYall, ΔZall) are set to fixed values which do not depend on the gradation values (r, g, b). However, there may be a case, depending on the characteristics of the liquid crystal display device 1000, that the relationship between the shift amounts (ΔXall, ΔYall, ΔZall) and the gradation values (r, g, b) does not have the linear shape. That is to say, there may be a case, depending on the characteristics of the liquid crystal display device 1000, that the shift amounts (ΔXall, ΔYall, ΔZall) are not accurately calculated in the case where the gradation values (r, g, b) are the specific gradation values when the values (Xr, Yr, Zr, Xg, Yg, Zg, Xb, Yb, Zb, Yw, xwt, ywt, zwt) which are the base of the calculation of the shift amounts (ΔXall, ΔYall, ΔZall) are set to the fixed values which do not depend on the gradation values (r, g, b).

In contrast, in the embodiment 2, the values (Xr(r), Yr(r), Zr(r), Xg(r), Yg(r), Zg(r), Xb(r), Yb(r), Zb(r), Yw(r), xwt(r), ywt(r), zwt(r)) which are the variable values depending on the gradation value r are used instead of the values (Xr, Yr, Zr, Xg, Yg, Zg, Xb, Yb, Zb, Yw, xwt, ywt, zwt) which are the fixed values which do not depend on the gradation values (r, g, b), Math (26), Math (27), and Math (28) are used instead of Math (4), Math (5), and Math (6), and the shift amounts (ΔXall(r), ΔYall(r), ΔZall(r)) in the case where the R component of the specific gradation values are r are calculated.

The values (Xr(g), Yr(g), Zr(g), Xg(g), Yg(g), Zg(g), Xb(g), Yb(g), Zb(g), Yw(g), xwt(g), ywt(g), zwt(g)) which are the variable values depending on the gradation value g are used instead of the values (Xr, Yr, Zr, Xg, Yg, Zg, Xb, Yb, Zb, Yw, xwt, ywt, zwt) which are the fixed values which do not depend on the gradation values (r, g, b), Math (29), Math (30), and Math (31) are used instead of Math (4), Math (5), and Math (6), and the shift amounts (ΔXall(g), ΔYall(g), ΔZall(g)) in the case where the G component of the specific gradation value is g are calculated.

The values (Xr(b), Yr(b), Zr(b), Xg(b), Yg(b), Zg(b), Xb(b), Yb(b), Zb(b), Yw(b), xwt(b), ywt(b), zwt(b)) which are the variable values depending on the gradation value b are used instead of the values (Xr, Yr, Zr, Xg, Yg, Zg, Xb, Yb, Zb, Yw, xwt, ywt, zwt) which are the fixed values which do not depend on the gradation values (r, g, b), Math (32), Math (33), and Math (34) are used instead of Math (4), Math (5), and Math (6), and the shift amounts (ΔXall(b), ΔYall(b), ΔZall(b)) in the case where the B component of the specific gradation value is b are calculated.

[Math 26]

$$\Delta Xall(r)=Yw(r)*xwt(r)-(Xr(r)+Xg(r)+Xb(r)) \quad (26)$$

[Math 27]

$$\Delta Yall(r)=Yw(r)*ywt(r)-(Yr(r)+Yg(r)+Yb(r)) \quad (27)$$

[Math 28]

$$\Delta Zall(r)=Yw(r)*zwt(r)-(Zr(r)+Zg(r)+Zb(r)) \quad (28)$$

[Math 29]

$$\Delta Xall(g)=Yw(g)*xwt(g)-(Xr(g)+Xg(g)+Xb(g)) \quad (29)$$

[Math 30]

$$\Delta Yall(g)=Yw(g)*ywt(g)-(Yr(g)+Yg(g)+Yb(g)) \quad (30)$$

[Math 31]

$$\Delta Zall(g)=Yw(g)*zwt(g)-(Zr(g)+Zg(g)+Zb(g)) \quad (31)$$

[Math 32]

$$\Delta Xall(b)=Yw(b)*xwt(b)-(Xr(b)+Xg(b)+Xb(b)) \quad (32)$$

[Math 33]

$$\Delta Yall(b)=Yw(b)*ywt(b)-(Yr(b)+Yg(b)+Yb(b)) \quad (33)$$

[Math 34]

$$\Delta Zall(b)=Yw(b)*zwt(b)-(Zr(b)+Zg(b)+Zb(b)) \quad (34)$$

Subsequently, the X component ΔXall(r) of the shift amounts including the contribution of all the components of the specific gradation values is multiplied by the contribution rate of the R component of the specific gradation values to calculate the X component correction amount ΔXr(r) in the case where the R component of the specific gradation values is r. The X component ΔXall(g) of the shift amounts including the contribution of all the components of the specific gradation values is multiplied by the contribution rate of the G component of the specific gradation values to calculate the X component correction amount ΔXg(g) in the case where the G component of the specific gradation values is g. The X component ΔXall(b) of the shift amounts including the contribution of all the components of the specific gradation values is multiplied by the contribution rate of the B component of the specific gradation values to calculate the X component correction amount ΔXb(b) in the case where the B component of the specific gradation values is b. The X component correction amounts (ΔXr(r), ΔXg(g), ΔXb(b)) are expressed by Math (35), Math (36), and Math (37), respectively.

[Math 35]

$$\Delta Xr(r) = \frac{Xr(r)}{Xr(r) + Xg(r) + Xb(r)} \Delta Xall(r) \quad (35)$$

[Math 36]

$$\Delta Xg(g) = \frac{Xg(g)}{Xr(g) + Xg(g) + Xb(g)} \Delta Xall(g) \quad (36)$$

[Math 37]

$$\Delta Xb(b) = \frac{Xb(b)}{Xr(b) + Xg(b) + Xb(b)} \Delta Xall(b) \quad (37)$$

The Y component ΔYall(r) of the shift amounts including the contribution of all the components of the specific gradation values is multiplied by the contribution rate of the R component of the specific gradation values to calculate the Y component correction amount ΔYr(r) in the case where the R component of the specific gradation values is r. The Y component ΔYall(g) of the shift amounts including the contribution of all the components of the specific gradation values is multiplied by the contribution rate of the G component of the specific gradation values to calculate the Y component correction amount ΔYg(g) in the case where the G component of the specific gradation values is g. The Y component ΔYall(b) of the shift amounts including the contribution of all the components of the specific gradation values is multiplied by the contribution rate of the B component of the specific gradation values to calculate the Y component correction amount ΔYb(b) in the case where the B component of the specific gradation values is b. The Y component correction amounts (ΔYr(r),ΔYg(g),ΔYb(b)) are expressed by Math (38), Math (39), and Math (40), respectively.

[Math 38]

$$\Delta Yr(r) = \frac{Yr(r)}{Yr(r) + Yg(r) + Yb(r)} \Delta Yall(r) \tag{38}$$

[Math 39]

$$\Delta Yg(g) = \frac{Yg(g)}{Yr(g) + Yg(g) + Yb(g)} \Delta Yall(g) \tag{39}$$

[Math 40]

$$\Delta Yb(b) = \frac{Yb(b)}{Yr(b) + Yg(b) + Yb(b)} \Delta Yall(b) \tag{40}$$

The Z component ΔZall(r) of the shift amounts including the contribution of all the components of the specific gradation values is multiplied by the contribution rate of the R component of the specific gradation values to calculate the Z component correction amount ΔZr(r) in the case where the R component of the specific gradation values is r. The Z component ΔZall(g) of the shift amounts including the contribution of all the components of the specific gradation values is multiplied by the contribution rate of the G component of the specific gradation values to calculate the Z component correction amount ΔZg(g) in the case where the G component of the specific gradation values is g. The Z component ΔZall(b) of the shift amounts including the contribution of all the components of the specific gradation values is multiplied by the contribution rate of the B component of the specific gradation values to calculate the Z component correction amount ΔZb(b) in the case where the B component of the specific gradation values is b. The Z component correction amounts (ΔZr(r), ΔZg(g), ΔZb(b)) are expressed by Math (41), Math (42), and Math (43), respectively.

[Math 41]

$$\Delta Zr(r) = \frac{Zr(r)}{Zr(r) + Zg(r) + Zb(r)} \Delta Zall(r) \tag{41}$$

[Math 42]

$$\Delta Zg(g) = \frac{Zg(g)}{Zr(g) + Zg(g) + Zb(g)} \Delta Zall(g) \tag{42}$$

[Math 43]

$$\Delta Zb(b) = \frac{Zb(b)}{Zr(b) + Zg(b) + Zb(b)} \Delta Zall(b) \tag{43}$$

Subsequently, the math formula of the left-hand side of Math (1) is corrected using the correction amounts (ΔXr(r), ΔXg(g), ΔXb(b), ΔYr(r), ΔYg(g), ΔYb(b), ΔZr(r), ΔZg(g), ΔZb(b)) indicating an offset (the correction amounts 1409) to generate the math formula of the left-hand side of Math (44).

[Math 44]

$$\begin{bmatrix} Xr + \Delta Xr(r) & Xg + \Delta Xg(g) & Xb + \Delta Xb(b) \\ Yr + \Delta Yr(r) & Yg + \Delta Yg(g) & Yb + \Delta Yb(b) \\ Zr + \Delta Zr(r) & Zg + \Delta Zg(g) & Zb + \Delta Zb(b) \end{bmatrix} \begin{bmatrix} r \\ g \\ b \end{bmatrix} + \begin{bmatrix} Xk \\ Yk \\ Zk \end{bmatrix} = Yw \begin{bmatrix} xwt \\ ywt \\ zwt \end{bmatrix} \tag{44}$$

After the math formula of the left-hand side of Math (44) is generated, the correction is performed using Math (17) to Math (25) in a manner similar to the embodiment 1.

3 Embodiment 3

The embodiment 3 relates to a liquid crystal display device being substitute for the liquid crystal display device according to the embodiment 1 or 2.

FIG. 1 to FIG. 7 and FIG. 9 also describe the liquid crystal display device according to the embodiment 3.

Described mainly hereinafter is a difference between the liquid crystal display device according to the embodiment 1 or 2 and the liquid crystal display device according to the embodiment 3.

Figure 10:
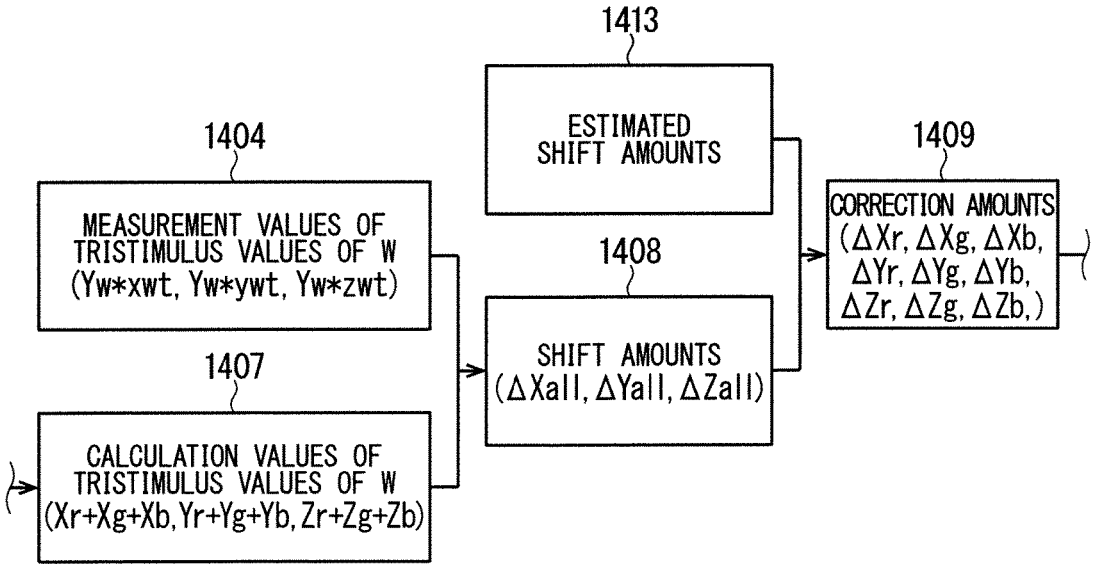
FIG. 10 is a drawing illustrating information used for the WB adjustment in the embodiment 3.

FIG. 10 is a drawing illustrating information used for the WB adjustment in the embodiment 3.

In the WB adjustment in the embodiment 1, as illustrated in FIG. 4, the correction amounts 1409 are calculated from the shift amounts 1408 between the measurement values 1404 of the tristimulus values of W before the WB adjustment is performed and the calculation values 1407 of the tristimulus values of W, so that the shift amounts between the measurement values of the tristimulus values of W after the WB adjustment is performed and the calculation values of the tristimulus values of W are not considered.

In contrast, in the WB adjustment in the embodiment 3, as illustrated in FIG. 10, estimated shift amounts 1413 between the measurement values of the tristimulus values of W after the WB adjustment is performed and the calculation values of the tristimulus values of W are considered when the correction amounts 1409 are calculated from the shift amounts 1408 between the measurement values 1404 of the tristimulus values of W before the WB adjustment is performed and the calculation values 1407 of the tristimulus values of W.

More particularly, in the WB adjustment of the embodiment 3, a relational expression generation unit 1323 estimates the estimated shift amounts 1413 between the measurement values of the tristimulus values of W after the WB adjustment is performed and the calculation values of the tristimulus values of W, and calculates the correction amounts 1409 so that the estimated shift amounts 1413 which have been estimated are reduced. Accordingly, in the WB adjustment of the embodiment 1, there may be a case where the calculation values of the tristimulus values of W are deviated from the measurement values of the tristimulus values of W after the WB adjustment is performed, so that the measurement of the tristimulus values needs to be performed again and the WB adjustment needs to be performed again, however, in the WB adjustment of the embodiment 3, the calculation values of the tristimulus values of W are hardly deviated from the measurement values of the tristimulus values of W after the WB adjustment is performed, thus it is hardly necessary to perform the measurement of the tristimulus values again and perform the WB adjustment again.

Since the shift amounts between the measurement values of the tristimulus values of W after the WB adjustment and the measurement values of the tristimulus values of W are not considered in the gradation values after the WB adjustment calculated from Math (16), the characteristics of the liquid crystal display device 1000 after the WB adjustment is performed is not reflected in the luminance value Yw' and the normalized tristimulus values (Xwt', Ywt', Zwt') calculated from Math (25). Thus, the luminance value Yw' and the normalized tristimulus values (Xwt', Ywt', Zwt') in which the characteristics of the liquid crystal display device 1000 after the WB adjustment is performed is reflected are calculated from Math (26).

[Math 45]

$$Yw''\begin{bmatrix} Xwt'' \\ Ywt'' \\ Zwt'' \end{bmatrix} = r\begin{bmatrix} Xr-\Delta Xr \\ Yr-\Delta Yr \\ Zr-\Delta Zr \end{bmatrix} + g\begin{bmatrix} Xg-\Delta Xg \\ Yg-\Delta Yg \\ Zg-\Delta Zg \end{bmatrix} + b\begin{bmatrix} Xz-\Delta Xz \\ Yz-\Delta Yz \\ Zz-\Delta Zz \end{bmatrix} \quad (45)$$

According to the WB adjustment of the embodiment 3, in the manner similar to the WB adjustment of the embodiment 1, the math formula for appropriately deriving the tristimulus values of the color displayed by the liquid crystal display device from the gradation values (r, g, b) is acquired even in the case where the additive color mixture is not established, thus the repetitive measurement of the tristimulus values is reduced, and the WB adjustment is appropriately performed.

In addition, according to the WB adjustment of the embodiment 3, the chromaticity value of W after the WB adjustment is performed is brought close to the target chromaticity value, and the WB adjustment can be performed without measuring the tristimulus values again.

4 Embodiment 4

The embodiment 4 relates to a liquid crystal display device substitute for the liquid crystal display device according to the embodiment 1.

Figure 11:
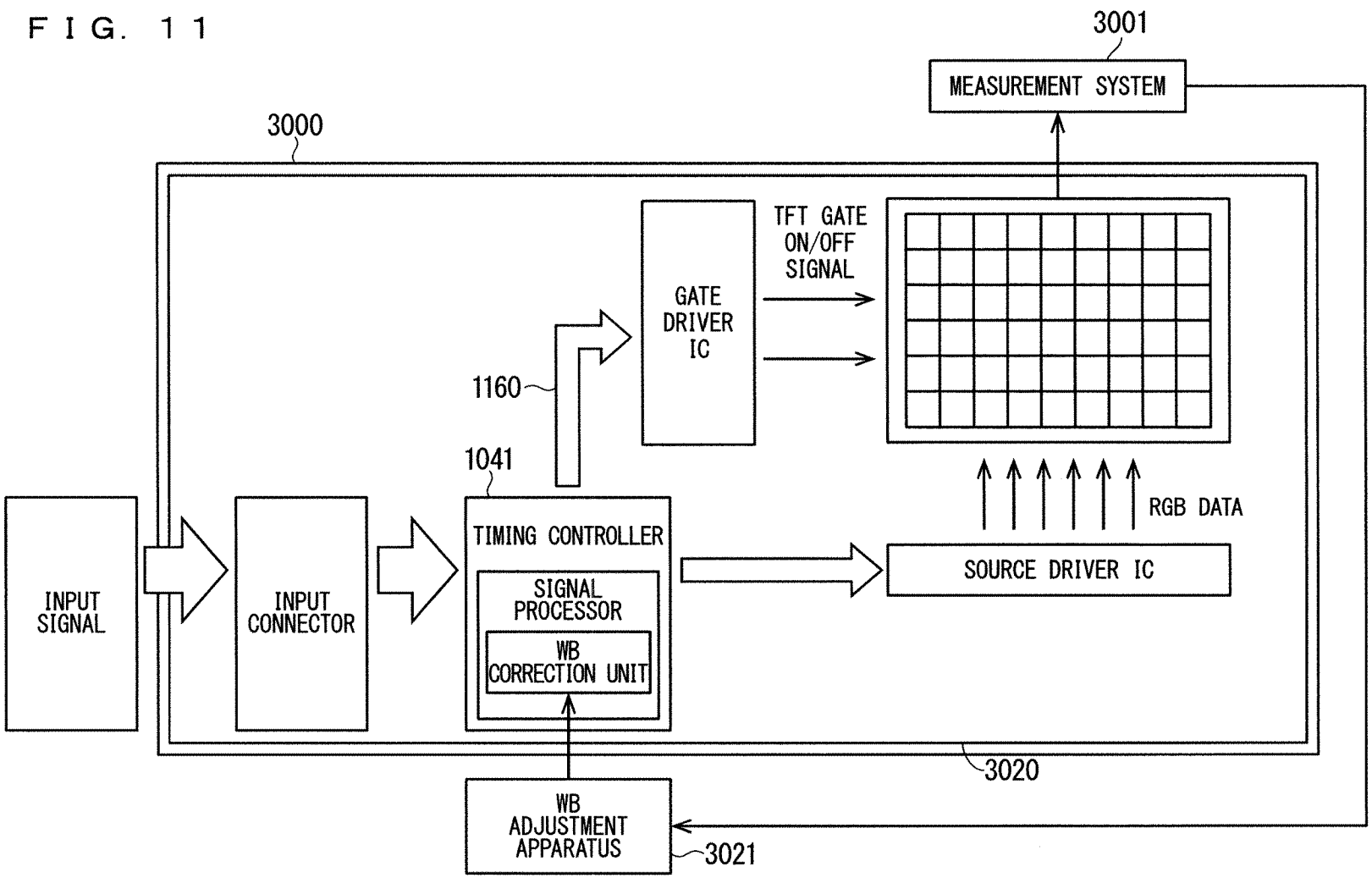
FIG. 11 is a block diagram illustrating a liquid crystal display device according to an embodiment 4 and a measurement system and a WB adjustment apparatus used for a WB adjustment in the liquid crystal display device according to the embodiment 4.

FIG. 11 is a block diagram illustrating the liquid crystal display device according to the embodiment 4 and a measurement system and a WB adjustment apparatus used for a WB adjustment in the liquid crystal display device according to the embodiment 4.

A liquid crystal display device 3000 illustrated in FIG. 11 includes a display mechanism 3020.

The display mechanism 3020 is similar to the display mechanism 1020 included in the liquid crystal display device 1000 according to the embodiment 1.

The measurement system 3001 and the WB adjustment apparatus 3021 are similar to the measurement system 1001 and the WB adjustment apparatus 1021 according to the embodiment 1, respectively. However, the WB adjustment apparatus 1021 is embedded in the liquid crystal display device 1000 in the embodiment 1, but the WB adjustment apparatus 3021 is not embedded in the liquid crystal display device 3000 in the embodiment 4.

As described above, the repetitive measurement of the tristimulus values performed by the measurement system 3001 is reduced, and the WB adjustment is appropriately performed, in a manner similar to the case where the WB adjustment apparatus 1021 is embedded in the liquid crystal display device 1000, also in the case where the WB adjustment apparatus 3021 is not embedded in the liquid crystal display device 3000.

According to the present invention, each embodiment can be arbitrarily combined, or each embodiment can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A method of adjusting white balance, comprising:

a) acquiring a measurement value of a color value of white color, in a display device performing a white balance correction of correcting first to $n^{th}$ gradation values before a correction to be first to $n^{th}$ gradation values after the correction and displaying a displayed color in accordance the first to $n^{th}$ gradation values after the correction, n indicating an integral number of three or larger, in a case where the first to $n^{th}$ gradation values after the correction are first to $n^{th}$ specific gradation values for making the display device display white color, respectively, and the displayed color is white color;

b) calculating a shift amount between the measurement value of the color value of white color and a calculation value of a color value of white color derived from the first to $n^{th}$ specific gradation values;

c) performing a generation of a math formula for deriving a calculation value of a color value of a displayed color from the first to $n^{th}$ gradation values after the correction, the reflection of the shift amount being performed on the math formula so that the calculation value of a color value of a displayed color is brought close to a measurement value of a color value of a displayed color;

d) calculating first to $n^{th}$ gradation values after a white balance adjustment which the first to $n^{th}$ gradation values after the correction take, respectively, in a case where the calculation value of the color value of the displayed color is a target color value of white color in the math formula; and e) adjusting contents of the white balance correction so that the first to $n^{th}$ gradation values after the correction are adjusted to the first to $n^{th}$ gradation values after the white balance adjustment, respectively, in a case where the first to $n^{th}$ gradation values before the correction are the first to $n^{th}$ specific gradation values, respectively.

2. The method of adjusting white balance according to claim 1, wherein the shift amount includes contribution of all the first to $n^{th}$ specific gradation values, the math formula includes first to $n^{th}$ coefficients respectively indicating degrees of contribution of the first to $n^{th}$ gradation values after the correction to the calculation value of the color value of the displayed color, and the reflection is performed by dividing the shift amount into first to $n^{th}$ correction amounts, respectively corresponding to contribution rates of the first to $n^{th}$ specific gradation values contributing to the correction amount, and respectively setting the first to $n^{th}$ correction amounts to be factors included in the first to $n^{th}$ coefficients.

3. The method of adjusting white balance according to claim 2, wherein the generation is performed by estimating an estimated shift amount between a measurement value of a color value of white color after the step e) is executed and a calculation value of a color value of white color derived from the first to $n^{th}$ specific gradation values, and then reducing the estimated shift amount.

4. The method of adjusting white balance according to claim 1, wherein the generation is performed by estimating an estimated shift amount between a measurement value of a color value of white color after the step e) is executed and a calculation value of a color value of white color derived from the first to $n^{th}$ specific gradation values, and then reducing the estimated shift amount.

5. A white balance adjustment apparatus, comprising:

a white color measurement value acquisition unit to acquire a measurement value of a color value of white color, in a display device performing a white balance correction of correcting first to $n^{th}$ gradation values before a correction to be first to $n^{th}$ gradation values after the correction and displaying a displayed color in accordance the first to $n^{th}$ gradation values after the correction, n indicating an integral number of three or larger, in a case where the first to $n^{th}$ gradation values after the correction are first to $n^{th}$ specific gradation values for making the display device display white color, respectively, and the displayed color is white color;

a shift amount calculation unit to calculate a shift amount between the measurement value of the color value of white color and a calculation value of a color value of white color derived from the first to $n^{th}$ specific gradation values;

a math formula generation unit to perform a generation of a math formula for deriving a calculation value of a color value of a displayed color from the first to $n^{th}$ gradation values after the correction, the reflection of the shift amounts being performed on the math formula so that the calculation value of a color value of a displayed color is brought close to a measurement value of a color value of a displayed color;

a gradation value calculation unit to calculate first to $n^{th}$ gradation values after a white balance adjustment which the first to $n^{th}$ gradation values after the correction take, respectively, in a case where the calculation value of the color value of the displayed color is a target color value of white color in the math formula; and a white balance adjustment unit to adjust contents of the white balance correction so that the first to $n^{th}$ gradation values after the correction are adjusted to the first to $n^{th}$ gradation values after the white balance adjustment, respectively, in a case where the first to $n^{th}$ gradation values before the correction are the first to $n^{th}$ specific gradation values, respectively.

6. A display device, comprising:

a display mechanism performing a white balance correction of correcting first to $n^{th}$ gradation values before a correction to be first to $n^{th}$ gradation values after the correction and displaying a displayed color in accordance the first to $n^{th}$ gradation values after the correction, n indicating an integral number of three or larger;

a white color measurement value acquisition unit to acquire a measurement value of a color value of white color in a case where the first to $n^{th}$ gradation values after the correction are first to $n^{th}$ specific gradation values for making the display mechanism display white color, respectively, and the displayed color is white color;

a shift amount calculation unit to calculate a shift amount between the measurement value of the color value of white color and a calculation value of a color value of white color derived from the first to $n^{th}$ specific gradation values;

a math formula generation unit to perform a generation of a math formula for deriving a calculation value of a color value of a displayed color from the first to $n^{th}$ gradation values after the correction, the reflection of the shift amounts being performed on the math formula so that the calculation value of a color value of a displayed color is brought close to a measurement value of a color value of a displayed color;

a gradation value calculation unit to calculate first to $n^{th}$ gradation values after a white balance adjustment which the first to $n^{th}$ gradation values after the correction take, respectively, in a case where the calculation value of the color value of the displayed color is a target color value of white color in the math formula; and a white balance adjustment unit to adjust contents of the white balance correction so that the first to $n^{th}$ gradation values after the correction are adjusted to the first to $n^{th}$ gradation values after the white balance adjustment, respectively, in a case where the first to $n^{th}$ gradation values before the correction are the first to $n^{th}$ specific gradation values, respectively.

* * * * *